United States Patent [19]

Francovitch

[11] Patent Number: 4,520,606

[45] Date of Patent: Jun. 4, 1985

[54] ROOF MEMBRANE ANCHORING SYSTEMS USING DUAL ANCHOR PLATES

[76] Inventor: Thomas F. Francovitch, 6373 Windharp Way, Columbia, Md. 21045

[21] Appl. No.: 461,453

[22] Filed: Jan. 27, 1983

[51] Int. Cl.[3] ..... E04B 2/08; E04D 3/36

[52] U.S. Cl. ..... 52/410; 52/509; 411/531

[58] Field of Search ..... 52/410, 509, 536; 411/531, 542

[56] References Cited

U.S. PATENT DOCUMENTS

| | | | |
|---|---|---|---|
| 2,020,767 | 11/1935 | Bullis et al. | 411/542 X |
| 3,918,233 | 11/1975 | Simpson | 52/536 X |
| 4,026,183 | 5/1977 | Bart | 411/542 |
| 4,074,492 | 2/1978 | Simpson et al. | 52/509 X |
| 4,074,501 | 2/1978 | Sandqvist | 52/410 X |
| 4,078,351 | 3/1978 | Simpson | 52/536 |
| 4,372,014 | 2/1983 | Simpson | 24/201 C |

FOREIGN PATENT DOCUMENTS

| | | | |
|---|---|---|---|
| 1609328 | 4/1970 | Fed. Rep. of Germany . | |
| 2339901 | 2/1975 | Fed. Rep. of Germany . | |
| 2711335 | 9/1978 | Fed. Rep. of Germany . | |
| 2826969 | 1/1980 | Fed. Rep. of Germany . | |
| 2330901 | 6/1977 | France | 411/531 |

*Primary Examiner*—J. Karl Bell

*Attorney, Agent, or Firm*—Irvin A. Lavine

[57] ABSTRACT

A roof membrane anchoring system is provided comprising upper and lower plates having a water impervious membrane between them. Fasteners secure the lower plate to the roof substrate, and the upper plate is secured against the membrane by a linear fastener penetrating the membrane or by a head and socket engagement without membrane penetration.

A plurality of membrane anchoring plates have extending between and secured to them linear elements over the membrane, to limit membrane lift forces.

36 Claims, 13 Drawing Figures

ROOF MEMBRANE ANCHORING SYSTEMS USING DUAL ANCHOR PLATES

TECHNICAL FIELD

The present invention relates to an anchoring system for a roof membrane used to prevent moisture from entering a structure such as a building.

BACKGROUND ART

For many years, roofs were of the built-up type, in which multiple layers of material, including a felt material soaked with bitumen, were used. Gravel was placed over this built-up roof, as a ballast to hold it down against being lifted by the wind. The built-up roof included bitumen as a material which would be impervious to penetration by moisture, such as rain.

In more recent times, an alternate roofing system has been employed, which is designated as "single-ply". The single-ply roofing system includes the application of a membrane of a suitable elastomeric material over a substrate. The substrate may be either rigid or non-rigid. Rigid substrates include concrete, sheet metal, as well as various types of insulation boards. Insulation boards include fiberboard, perlite board, fiberglass with binder, urethane, urethane with composite of fiberboard, perlite or fiberglass, polystyrene, cellular glass and cork board. Non-rigid roofing materials include batt or blanket types of insulation,, which is compressible, as for example, by a fastener which penetrates the insulation as well as a membrane which is placed over the installation.

The membrane may be made of various selected materials, including chlorinated polyethylene, ethylene propylene diene monomer, chlorosulfonated polyethylene, modified bitumen, neoprene, polyisobutylene and polyvinyl chloride. These materials are generally produced in sheets which are transported in rolls, which are often sold in widths of from about 3 feet to as much as approximately 40 feet, and the length may be as much as 125 feet.

The membrane must not only be waterproof, but must be prevented from being lifted by wind forces. A waterproof membrane construction is achieved by applying the membrane in sheets or strips, lapping one over the other, and providing a joint at the overlap, which is waterproof and moisture proof. Also, of course, flashing in one form or other is utilized at the edges of the membrane, at pipes, etc.

The adherence of the membrane to the roof is achieved in several different ways. One is a loose-laid ballast system, in which small stones are placed over the membrane, to hold it down. Another is the partially attached system, in which fasteners penetrate the membrane and are secured to the substrate, such as the rigid insulation boards above-mentioned. The partially-attached single-ply system may be utilized with either strips or various so called "point attachment" constructions. There is also a totally adhered system, in which the entire undersurface of the membrane is adhered by a suitable adhesive to the substrate, as well as a so called protected membrane roof, which provides for insulation over the membrane.

In the partially-attached single-ply systems, there are several problems which must be overcome. In both of the "point attachment" constructions, in which a plate or disc is over the membrane and has a linear fastener passed through it and through the membrane into the underlying roof structure, herein called the roof substrate, there is used only a single fastener for each such plate or disc. In areas where there are strong wind forces, this neccessitates the utilization of a higher concentration of the discs or plates, and the construction must have suitable protection against the entry of water into the building structure by finding a passage-way along the fastener and through the penetrated membrane. Similarly in the strip attachment, to provide for suitable security in high wind areas, the strips must be more closely concentrated, and suitable provision must be made to insure against water leakage through the membrane where it is penetrated by the linear fasteners.

While various partially attached systems, as above described, have been installed in recent times, and have proven to be satisfactory, improvement is needed to achieve satisfactory membrane hold-down in high wind areas, without increasing the concentration of the discs, or strips, and the attendant expenses. In addition, improvement is needed in providing a system in which the membrane is not penetrated, so as to avoid the possibility that precautions taken to prevent water leakage along the fastener and through the penetrated membrane are not successful.

DISCLOSURE OF INVENTION

The present invention is directed to a single-ply roof anchor system, including a water and moisture impervious membrane, and upper and lower plates for anchoring the membrane to the roof. In a first embodiment, a plurality of linear fasteners extend through the lower plate, and secure it to the roof substrate. The upper plate cooperates with the lower plate, compressing the membrane between them, and a fastener secures the upper plate in position so as to hold it against the membrane. To effect the holding of the top plate, one or more screws may be used, securing it to the lower plate, or, a screw may be passed through the upper plate, the membrane and the lower plate and into the substrate, to hold both the upper and lower plate in position; optionally additional screws or other linear fasteners may be utilized to hold the lower plate in position against the roof substrate.

In another embodiment, there is provided a membrane with upper and lower plates, and a head and socket connection for clamping an upper element or plate to a lower element or plate, with a portion of the membrane between them, the membrane not being penetrated. A fastener is provided, extending only through the lower plate or element and into the roof substrate. In these embodiments of the invention, the head is preferably on the lower plate or element, and is resiliently contractable, so that the socket forming a part of the upper plate or element may cause it to contract while assembly is being effected, later to expand into a locking relationship with the upper element, after the upper element is fully positioned. In this embodiment, also, the lower element may be in the form of a plate or disc, provided with a head, or may be a linearly extending strip with plural heads.

In yet another embodiment of the invention, linear hold-down elements extend between adjacent upper plates or discs, so as to restrict the extent of billowing of the membrane under high wind conditions; lower plates may be present.

Among the objects of the present invention are to provide an improved roof membrane anchoring structure suitable for use in areas of high wind, and more particularly an object of the present invention is the provision of such a structure providing superior anchoring stength. Still another object of the present invention is the provision of a roof membrane anchoring structure which will provide for stressing an upper plate by a lower plate, so as to provide greater resistance to deflection of the upper plate by lift forces generated by a wind-lifted membrane. Yet another object of the present invention is the provision of a roof membrane anchoring structure provided with dual plates, for a greater anchoring security and greater engagement of the membrane by the plates.

Another object is to provide a roof membrane partially attached anchoring system providing security against separation, economy of materials, low installation costs and requiring conventional tools and equipment, such as fastener driven, and mastic applicators. Still another object of the present invention is a provision of a roof membrane anchoring structure wherein great security against water leakage is provided, and more particularly to provide such a structure wherein the membrane is secured through a partially-attached system, with attendant economies of materials and labor, in which membrane penetration does not occur and which uses conventional roofing installation equipment.

Still another object of the present invention is the provision of a roof membrane anchoring system wherein provision is made against the formation of large billows in a partially-attached roof anchoring system.

Other objects and many of the attendant advantages of the present invention will be readily understood in the following specification, claims and drawings.

DESCRIPTION OF THE PREFERRED EMBODIMENTS

Figure 1:
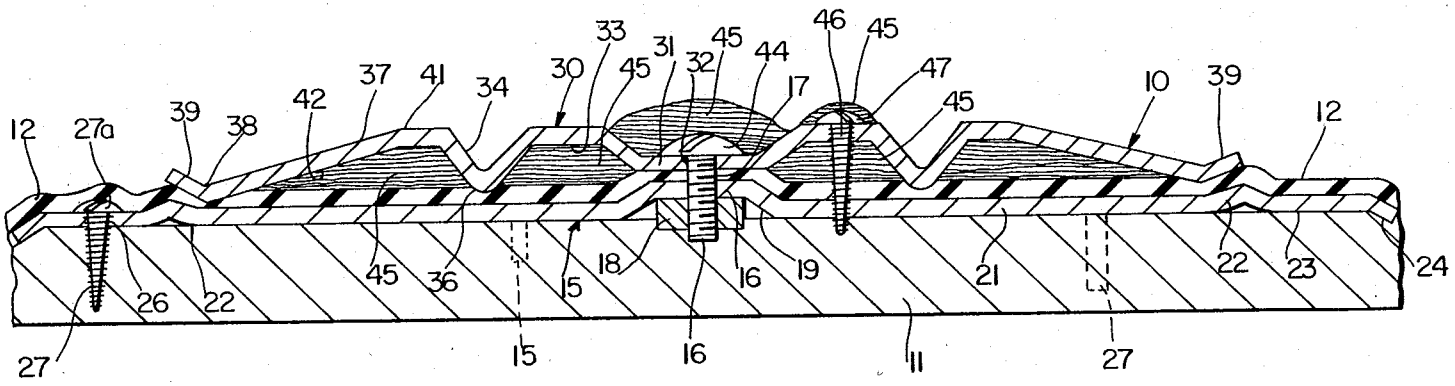
FIG. 1 is a vertical cross-sectional view through a first embodiment of a roof membrane anchoring structure and substrate, in accordance with the present invention.

Referring now to the drawings, wherein like or corresponding reference numerals are used to designate like or corresponding parts throughout the several views, there is shown in FIG. 1 a vertical cross-sectional view of a roof membrane anchoring structure generally designated 10 shown in place upon a roof substrate 11. Roof substrate 11 may be of any roof material, including, but not limited to, rigid roof insulation, an existing built-up roof, gypsum, wood, concrete or steel, such as a corrugated steel plate. It is of the usual characteristics for such materials.

A membrane 12 is placed over the roof substrate 11, and may be of known materials, as hereinabove set forth. Many of these materials are elastic, as well as being impervious to moisture and water. However, because of their exposure to heat, the membrane materials are not thermoplastic at temperatures which occur on roofs.

The anchoring structure 10 includes a lower plate 15 having a raised central portion 16, having an opening 17 therethrough. A nut 18 is provided, secured to the bottom surface of the central region 16 with the threaded opening therein in alignment with the opening 17. Outwardly of the central region 16 there is a conical portion 19, and outwardly thereof there is a flat annular portion 21, bounded by an upstanding annular ridge 22; outwardly of the ridge 22 is a second annular portion 23, and the bottom plate 15 is preferably bounded at its periphery by a down-turned lip 24.

Figure 2:
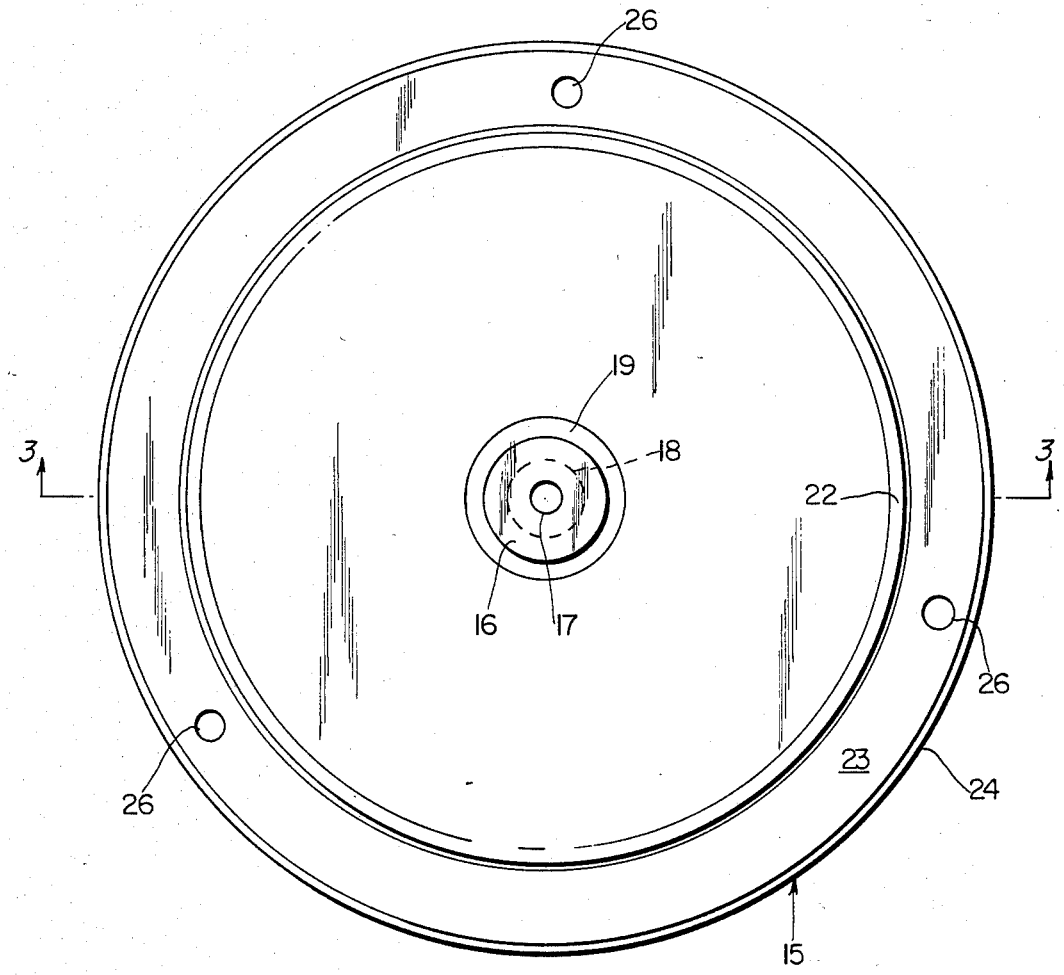
FIG. 2 is a top plan view of the upper plate of the structure of FIG. 1.
Figure 3:
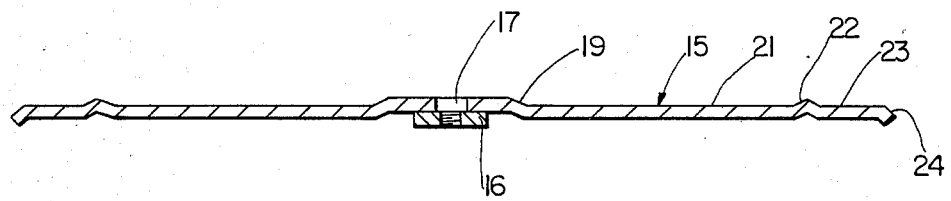
FIG. 3 is a cross-sectional view taken on the line 3—3 of FIG. 2.

Referring to FIGS. 2 and 3, there may be seen the bottom of lower plate 15, central region 16, opening 17, nut 18, conical portion 19, the flat annular portion 21, the ridge 22, annular portion 23 and lip 24. In addition, there is clearly shown in FIG. 2 a plurality of openings 26, here shown as three such openings, for optionally receiving linear fasteners. As shown in FIG. 1, a linear fastener 27 is shown extending through the opening 26, and a second fastener 27 is shown in dashed lines. Fastener 27 is shown as a screw having a shank with threads, and a head 27*a* which is above the bottom or lower plate 15. As will be readily understood, the linear fastener 27 is exemplary, as shown, and may be a fastener of a type other than a screw. The use of two or more linear fasteners provides greater strength of attachment of the lower or bottom plate 15 to the roof substrate 11, and as will be understood, as many openings 26 and fasteners 27 may be provided as dictated by anticipated wind conditions, and resultant uplift forces tending to cause disengagement of the anchoring structure 10 from the substrate 11. The fasteners 27 are conventional and may be positioned by ordinary screw drivers, or other conventional roofing tools.

The upper plate 30 is of stamped sheet metal, or of other material, so as to provide a disc which is resilient. It includes a central, substantially planar region 31, having an opening 32 centrally therein, and extending through the resilient plate 30. A downwardly facing cavity 33 is provided outwardly of and in surrounding relationship to the central region 31, and is defined by an annular portion of the plate 30 which is at a level above the level of the central region 31, the central region 31 thereby being recessed relative to the annular region defining the cavity 33. Outwardly of the cavity 33 there is a V-shaped groove 34, having on the undersurface of the plate 30 an annular contact region 36. A downwardly sloping region 37 extends outwardly from the groove 34 and is provided with a flexure zone 38 at the outer boundary thereof, with a peripheral region 39 in surrounding relationship to the flexure zone 38, and located at a level below the contact region 36 and the central region 31 in the unstressed state of the upper plate 30. The downwardly sloping region 37 has at its inner boundary a bending zone 41 which will bend upon stressing of the upper plate 1 in a manner to be hereinafter set forth. In the unstressed condition of the plate 30, the contact region 36 is preferably slightly below the central region 9, the region defining the cavity 33 being at approximately the same level as the region of the plate 30 outwardly of the groove 34, that is, between the outer margin of groove 34 and bending zone 41.

The annular cavity 33 is preferably filled with mastic 45, and outwardly of the cavity 33, separated from it by the contact region 36, is a second cavity 42 which underlies a portion of the groove 34, and extends outwardly to approximately the beginning of the flexure zone 38, and this second annular cavity is also filled with mastic 45.

As will be noted, the peripheral region 39 is above and is acted upon by the ridge 22 during installation, ridge 22, tending to force it upwardly. A screw 43 having a head 44 is shown passing through the opening 32 in upper plate 30, the opening 17 in bottom or lower plate 15, and in threaded engagement with nut 18. The head 44 of screw 43 is covered by mastic 45 to prevent moisture from penetrating into the substrate 11 along screw 43.

To install a roof membrane anchoring structure 10, a plurality of bottom or lower plates 15 are placed in position on a roof substrate, typically in a grid pattern. Then, one or more of the linear fasteners 27 are used to secure each of the lower or bottom plates 15 is position on the substrate 11. Preferably, such bottom or lower plate 15 is a disc, and as will be understood, if the material of substrate 11 will not permit penetration thereinto of the lip 24 and nut 18, as shown in FIG. 1, suitable modification may be made, including reducing the angle of the lip 24, or eliminating it, as well as reducing the thickness of nut 18, or providing a central region 16 which extends to a higher elevation than that shown in FIG. 1. The membrane 12 is then placed in position over the lower or bottom plates 15, with adjacent strips provided with a waterproof joint as is known to those skilled in the art. The membrane is penetrated by a suitable instrument, or screw 43, over the opening 17 in the bottom or lower plate 15, and the upper plate 30 then has mastic 45 applied to its cavities 33 and 42, after which it is placed in position with its opening 32 in alignment with the opening 17 in the bottom or lower plate 15. Screw 43 is then passed through the aligned openings, and engaged with nut 18. As the screw 43 is threaded into nut 18, or even before, in some instances, the upper plate 30 is stressed, so as to cause it to form a somewhat less arcuate configuration, the flexure zone 38 and bending zone 41 flexing and bending, and contact region 36 engaging the membrane 12, and, where it is elastic, causing it to be compressed or distorted. Stressing of the upper plate 30 is enhanced by the interaction of the ridge 22 and the peripheral region 39, to cause greater flexing of upper plate 30 than would otherwise occur, thereby providing it with greater resistance to failure due to uplift forces caused by billowing of the membrane 12 in a strong wind. There are provided, as shown, two separate annular surrounding mastic bodies, separated by the contact region 36, so as to provide a structure which will not permit water, as from rain or melting snow, to penetrate along the top of the membrane 12 to the opening therein through which the screw 43 passes. The mastic 45 above the head 44 of the screw 43 also prevents entry of such water into the structure 10 so as to block penetration of moisture by that path.

The structure 10 as shown in FIG. 1 will thereby be seen to provide a roof membrane anchoring structure capable of having a plurality of linear fasteners utilized to hold the structure in position on the roof substrate. In addition, the upper plate is stressed, against uplift by forces generated by a billowing membrane 12, and the surrounding mastic masses or bodies 45 prevent entry of water, as does the mastic body 45 above the head of the screw 43.

The upper plate 30 is held against separation by the screw 43, threaded into the nut 18. In addition, one or more screws 46, which may optionally be of the selftapping type, are provided, extending through an opening 47 in upper plate 30, through a body of mastic 45, penetrating the membrane 12, and being threaded into the bottom or lower plate 15. Screw 46 may even, if desired, extend into and be in engagement with the substrate 11. As many of the screws 46 as deemed advisable may be utilized, and the screws 46 may be placed not only above the cavity 33, but at the groove 34 and in the sloping region 37, or the flexure zone 38. The heads of such supplemental screws 46 may be covered with a body of mastic 45, as shown. Such supplemental screws provide for greater security against separation of upper plate 30.

Figure 4:
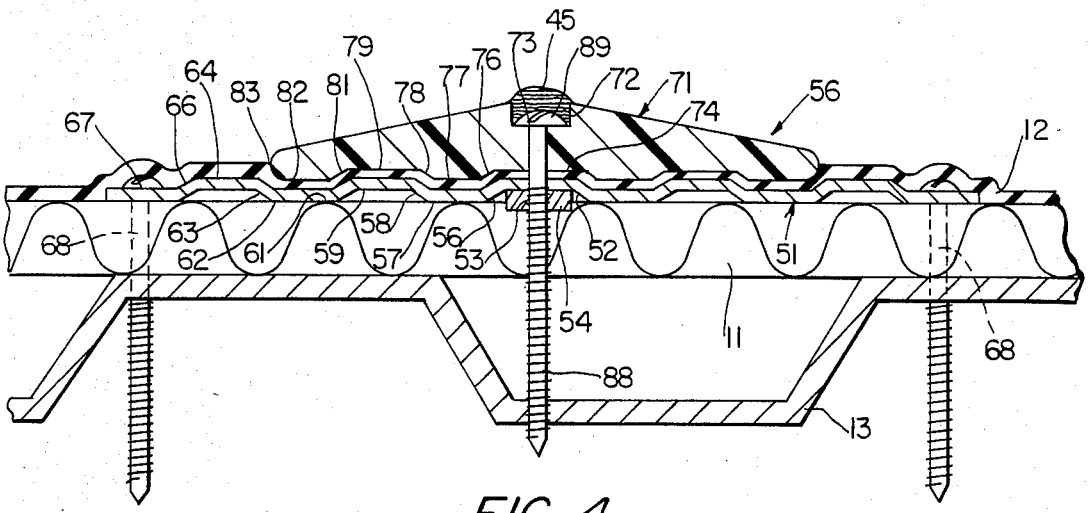
FIG. 4 is a cross-sectional view of another embodiment of a roof membrane anchoring structure in accordance with the present invention.

Referring now to FIG. 4, a roof membrane anchoring structure 50 is shown, for holding the membrane 12 to a substrate 11, which may be, for example, a sheet of insulating material, gypsum, etc., supported by a corrugated or ribbed metal support 13. Lower or bottom plate 51 is preferably of disc shape, having a raised central region 52 with an opening 53 centrally therein. Below the opening 53 is a nut 54 which, as shown, partially penetrates into substrate 11, but need not do so, as hereinabove indicated. A downwardly extending conical region 56 lies outwardly of central region 52, followed in succession by a flat region 57, an upper conical region 58, a raised flat region 59, a downwardly extending conical region 61, a second flat region 62 substantially coplanar with region 57, an upwardly extending conical region 63, another flat annular region 64, a downwardly extending conical region 66 and a peripheral flat region 67.

A plurality of linear fasteners 68 extend through the lower or bottom plate 51 to secure it to the substrate 11 and/or the ribbed metal support 13. The fasteners 68 are shown extending through the region 67, but may extend through some other portion of the bottom or lower plate 51. As many fasteners 68 may be used as are required by the particular environmental conditions, and as will be hereinbelow set forth, in some areas the fasteners 68 may be omitted.

Overlaying the lower bottom plate 51 is the membrane 12, and on the membrane 12 is the upper plate 71 which has a central opening 72, being a relatively thick body and having on its underside a configuration which matches or is complementary to the annular ridges and grooves provided by the annular undulations in the bottom or lower plate 51. Thus, the upper plate 71 has a flat central region 72 opposite the central region 52, and an opening 73 extending therethrough in alignment with the opening 53. A downwardly sloping conical region 76 is opposite and above the downwardly sloping conical region 56, followed, in outward progression, by a flat region 77 opposite region 57, a conical region 78 opposite conical region 58, a flat region 79 opposite the region 59, a conical region 81 opposite conical region 61, a flat region 82 opposite flat region 62 and, finally, a conical region 83 opposite conical region 63.

A fastener 88 extends through the opening 73, and has an upper portion threadedly engaged with the nut 54, and a lower portion threadedly engaged with the ribbed metal support 13 and/or the substrate 11.

The fastener 88 will be seen to cooperate with another element, so as to clamp membrane 12 between upper plate 71 and lower plate 51, this clamping action compressing the membrane 12, thereby preventing the ingress of water along the top of the membrane 12 to the fastener 88, and thus prevents water from entering into the roof substrate along the fastener 88. Under conditions of high wind forces, a sufficient number of linear fastener 68 are used to ensure security of the lower plate 51 on the substrate 11. Optionally, the linear fastener 88 may extend only to the nut 54, and have little or no engagement either with substrate 11 or ribbed metal support 13. Alternatively, the fastener 88, as above indicated, may have engagement both with nut 54 and/or substrate 11 and/or ribbed metal support 13. Where there are provided a substrate 11 and/or ribbed metal support 13 which would provide sufficient holding force for fastener 88, the fasteners 68 may be eliminated, thus saving both material and labor cost. Thus, the roof membrane anchoring structure 50 of FIG. 4 may have alternative fastener utilization, positioning and engagement, so as to achieve suitable holding of the upper plate 71 and lower plate 51 to the substrate 11 and/or ribbed metal support 13, while using the minimum number of fasteners which may be required for a particular installation, considering wind forces which would tend to raise the membrane 12, and thereby exert a separation force on upper plate 71, or on upper plate 71 and lower plate 51.

The fastener 88 will be seen to have a head 89, over which is a body of mastic 45, the head 89 engaging the upper plate 71, for the purpose of securing the upper plate 71 against and forcefully clamping and compressing membrane 12 against the lower plate 51, the fastener 88 being secured either to the lower plate 51, as through nut 54, or substrate 11 or ribbed metal support 13, or more than one of them.

Figure 5:
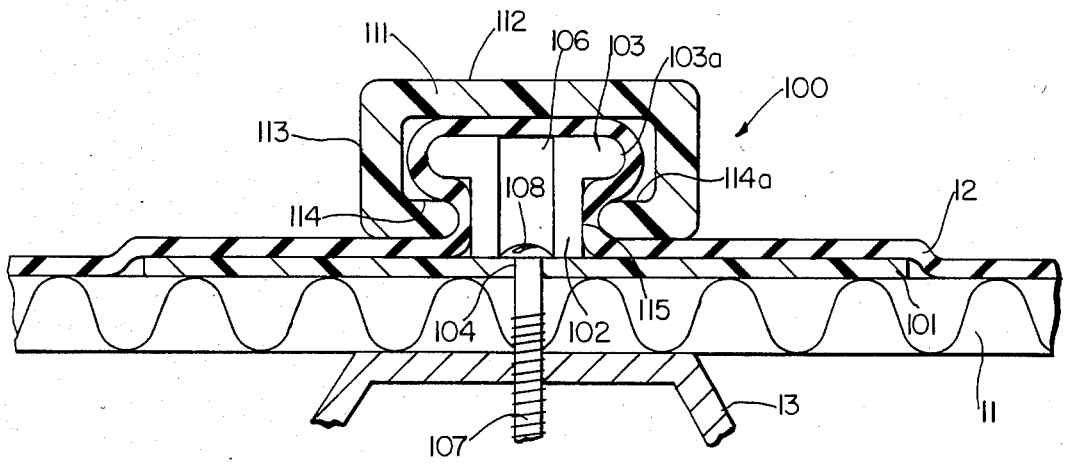
FIG. 5 is a vertical cross-sectional view through a roof membrane anchoring structure in accordance with the present invention in which the membrane is not penetrated.

Referring now to FIG. 5, there is shown a roof membrane anchoring system 100, characterized by a head and socket arrangement. Thus, there is provided a lower plate 101 or resilient material, in engagement with a substrate 11, and having a central, preferably cylindrical upstanding neck 102, above which is an outstanding head 103, which, together with the neck 102, is preferably axially segmented. A central opening 104 is provided, enlarging at its upper end to a central recess 106. A fastener 107 has a head 108 in the recess 106, and its shank passing through the central opening 104, fastener 107 being secured to the substrate 11, or some other portion of the roof structure, thereby to hold the lower plate 101 in position on the substrate 11. The lower plate 101 may be in the form of a disc, or some other form, such as a polygon. In its polygonal form, the lower plate 101 may be a linearly extending strip having a plurality of necks 102 and heads 103 placed at suitable spacing therealong. The bottom plate 101, like upper plate 71 and/or lower plate 51, as well as the plates 15 and 30, may be of a suitable rubber or plastic material.

The upper plate 111 provides an upper, horizontal wall 112, a peripherial, depending and surrounding wall 113 and a re-entrant wall 114 extending radially inwardly and having a central opening 115 of a diameter which is greater than the diameter of neck 102 and the compressed thickness of membrane 12, but less than the diameter of the head 103 in the position shown in FIG. 5.

The head 103 is provided with a camming surface **103*a*, which is peripherally extending, and is provided by a rounded edge of the head; it is engaged by the camming surface 114*a* at the inner rounded edge of the re-entrant wall 114. It will be understood that the upper plate or member 111 is relatively rigid, so as to not be distorted by the forces which would tend to separate it from the lower plate or element 101, generated by wind lifting forces acting on the membrane 12. Further, the diameter of the head 103 and the inward extent of the re-entrant wall 114 are chosen relative to each other so that the upper plate or element 111 may be positioned on the head 103 without difficulty, while still providing secure, interlocking engagement of the upper plate or element 111 on the lower plate or element 101. Accordingly, FIG. 5** is illustrative of the general organization.

To install the roof membrane anchoring structure 100, the lower member or plate 101 is placed on the substrate 11, and the fastener 107 is passed through the opening 104, and into the roof substrate 11 or other fixed portion of the roof, being secured thereto in known manner. Although a single fastener 107 has been shown, it will be understood that additional fastener or fasteners may be utilized, extending through the lower plate 101 and into the substrate 11, to provide greater security. A suitable number of the lower plates 101 will be placed in position, having one or more necks 102 and heads 103 thereon. The membrane 12 is then placed over the roof substrate and over the thus secured bottom plates 101, a plurality of sheets or strips, as necessary, being joined by suitable waterproof securing means. The membrane 12 is gathered, as by utilizing its elasticity, at each of the heads 103, and then, with use of a lubricant if necessary, the upper member or plate 111 is positioned over the head 103 and is pushed downwardly. This action will cause the segmented neck 102 and head 103 to contract, so as to permit the head 103 to pass through the central opening 115 provided in the re-entrant wall 114, the resiliency of the material and its configuration causing the head 103 then to expand outwardly into the position shown in FIG. 5, so as to provide a locking relationship between the lower plate 101 and the upper plate 111.

The roof membrane anchoring system 100 as shown in FIG. 5 does not require the utilization of mastic, thereby conserving both time and materials in comparison to other systems, and, significantly, there is no penetration of the membrane 12. However, even without penetration of the membrane 12, the membrane is secured in position on the roof substrate 11, and uplift forces due to wind will neither separate the upper plate or member 11 from the lower plate or member 101, nor will there be a separation of the lower plate or member 101 from the roof substrate 11.

Figure 6:
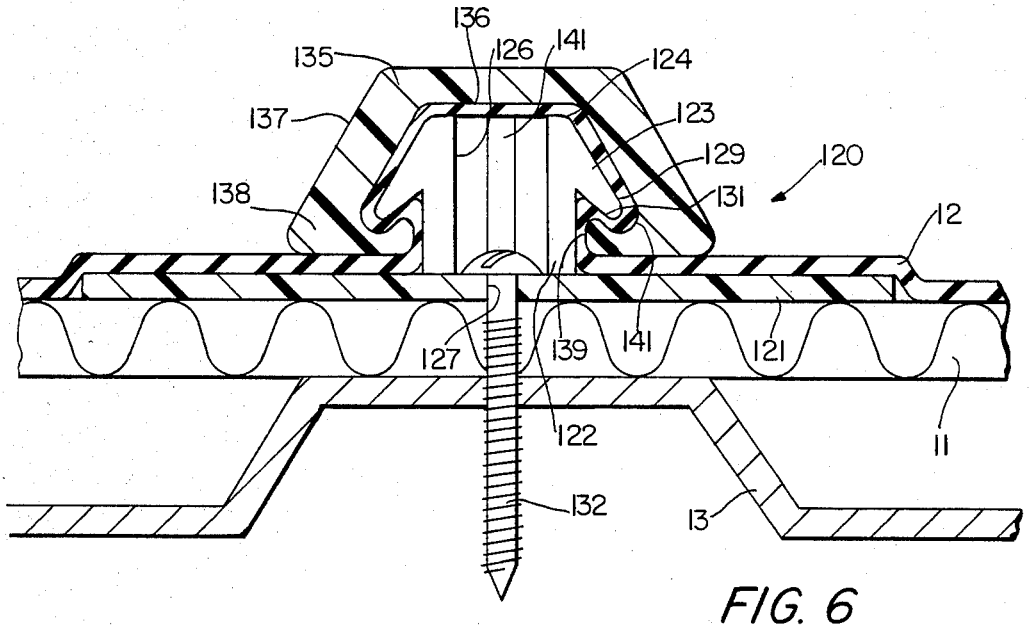
FIG. 6 is a view similar to FIG. 5, showing another embodiment thereof.

FIG. 6 discloses a roof membrane anchoring system 120 for securing the membrane 12 to the substrate 11 and/or to a ribbed metal support 13. There is provided a lower element or plate 121 having one or more upstanding necks 122, surmounted by a head 123 having a flat upper surface 124 penetrated by a recess 126 and a connecting opening 127. Outwardly of the surface 124 there is on head 123 a conical camming surface 129, head 123 at its lower end, at the bottom of the conical camming surface 129, having a substantially greater diameter than the neck 122, thereby providing a locking shoulder 131. A linear fastener 132 extends through the opening 127 to secure the lower plate 121 to the substrate 11 and/or the ribbed metal support 13.

The membrane 12 will be seen extending over the lower plate or element 121, and over the head 123 thereof.

The upper element or plate 135 provides a socket, having an upper wall 136, an outwardly and downwardly flaring or conical wall 137, having at its lower end an annular inwardly directed wall 138, providing an opening 139 therethrough. On the upper surface of the wall 138 is a shoulder 141 which underlies the shoulder 131 of the head 123.

Figure 7:
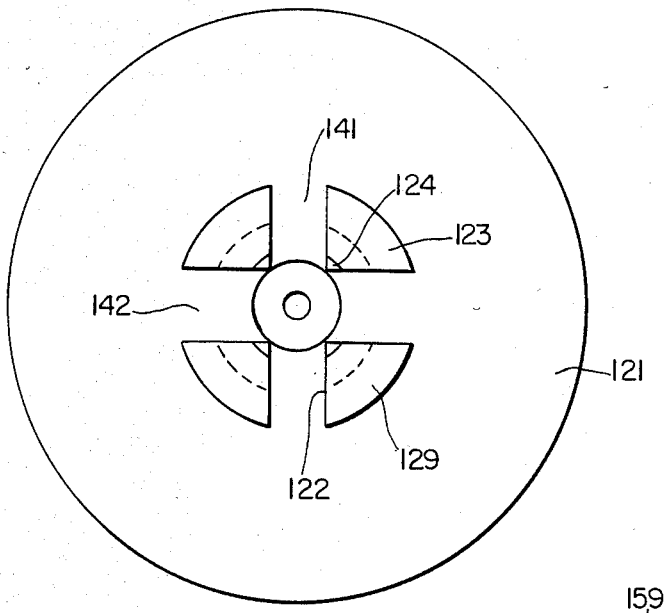
FIG. 7 is a top plan view of the lower element of FIG. 6.

Referring now to FIG. 7, there is shown the lower element or plate 121, with the head 123 comprised of the upper surface 124 and the truncated conical surface 129. The neck 122 is also shown, and of particular significance are the vertical and axially extending grooves 141 and 142 which divide the head 123 and neck 122 into segments, so that upon engagement of the inner lower camming edge or surface of the wall 138 with the truncated conical camming surface 129, the head 123 and neck 122 will be radially contracted, so as to permit the head 123 to pass through the opening 139 and into the socket thereabove provided in the upper element 135.

In FIG. 7, the lower element or plate 121 is shown as being in the form of a disc, with an upstanding generally segmented cylindrical neck 122 and generally segmented, concial head 123. However, the lower element 121 may not be in the form of a circular plate, as shown in FIG. 7, but may be longitudinally extending, with a plurality of such necks 122 and head 123, and the anchoring system 100 of FIG. 5 may also be so configured.

Figure 8:
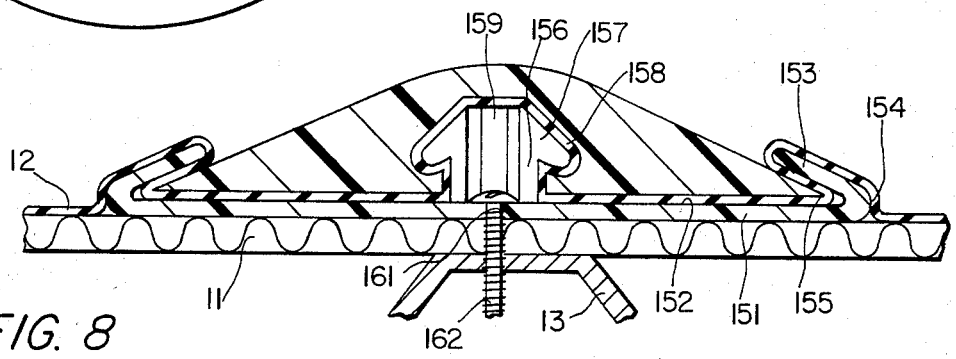
FIG. 8 is a cross-sectional view of another embodiment of a roof membrane anchoring structure in accordance with the present invention, wherein the membrane is not penetrated.
Figure 9:
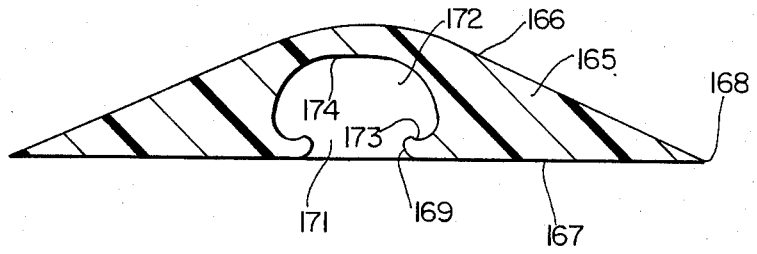
FIG. 9 is a cross-sectional view of the upper element of FIG. 8.

Referring now to FIGS. 8 and 9, there is shown in FIG. 8 a membrane anchoring system including a lower plate or element 151 having an upper surface 152, having an inclined, overhanging shoulder 153 inwardly of the peripheral edge 154 thereof. The shoulder 153 provides, with the surface 152, a re-entrant groove 155.

At its center, the lower plate or element 151 has an upstanding, generally cylindrical neck 156 surmounted by a peripherally extending and enlarged head 157 having a camming surface 158 at it outer shoulder, provided by a generally rounded edge, and having a recess 159 connected with a bore 161 through the base of lower element 151. Lower element 151 rests upon a substrate 11, which may be supported, as shown, by a ribbed metal support 13. A fastener 162 extends through the recess 159, and bore 161, and is secured to either or both of the substrate 11 and ribbed metal support 13 thereby to secure the lower plate or element 151 in position on the substrate 11. As will be understood, the lower plate or element 151 may be simply a disc, or may be a linearly extending strip having a series of configurations each including a neck 156, head 157 and shoulder 153 providing a re-entrant groove 155.

The membrane 12 is placed over the lower plate or element 151, and since it is either provided with suitable extra material for gathering, or is elastic, or both, may be caused to have the configuration shown in FIG. 8, wherein it enters the re-entrant groove 155, and extends along the neck 156, and both beneath and over the head 157. As will be understood, the material of the lower plate or element 151 is somewhat rubber-like, having resiliency, and the neck 156 and head 157 are provided with vertical, axially extending grooves, in the manner shown in FIG. 7, so as to permit contraction of the head 157 and neck 156, and then the resumption of the position shown in FIG. 8.

In FIG. 9, there is shown the upper plate or element 165 of the roof membrane anchoring system 150, comprising a relatively hard and unyielding substance, such as a hard plastic. The upper plate or element 165 may be of generally conical shape, having an upper conical surface 166, and a lower, annular surface 167 which is generally flat. A peripheral edge 168, which is generally rounded, is provided at the outer margin of the annular surface 167, and at its inner margin, there is provided a camming surface 169, which is annular and which defines an opening 171. Opening 171 leads ot a head-receiving socket 172 defined by an inwardly directed shoulder 173. The vertical height of the socket 172 between the shoulder 173 and the wall 174 which defines the socket 172 is such as to accommodate the head 157, and the portions of the membrane 12 overlying the head 157. In addition, the diameter of the opening 171 is such as to accommodate the neck 156 and the portion of the membrane 12 which surrounds it.

In use, after the lower plate or element 151 has been secured or fastened in the manner above described, and the membrane 12 has been placed in position, with gathering or stretching as may be required, the upper plate or element 165 is placed in position, with camming surface 169 of the upper plate or element 165 being in juxtaposition with the camming surface 158 of lower plate or element 151, membrane 12, of course, preventing actual engagement of the surfaces. Pushing downwardly on the upper plate or element 165 will cause the head 157 and neck 156 to contract, permitting downward progress of the upper plate or element 165. The shoulder 153, being part of the somewhat flexible and resilient lower plate or element 151, may be raised, by stretching it, or by use of a tool (such as a "shoe-horn") so as to enable the outer peripheral region of the upper element 165 to pass the edge of shoulder 153 and enter into the re-entrant groove 155.

Figure 10:
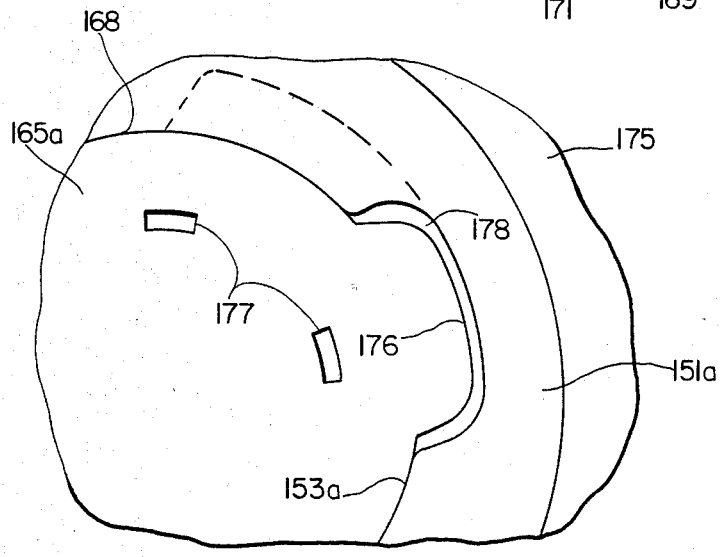
FIG. 10 is a fragmentary plan view of an embodiment similar to FIG. 8.

In FIG. 10, there is shown a segmental view of an alternate embodiment of a roof membrane anchoring system 175, which is generally similar to the roof membrane anchoring system 150, except that the upper plate or element **165*a* is provided at the peripheral edge 168 with a plurality of outwardly extending lugs 176, and a plurality of gripping elements 177, which may be placed at convenient locations on the upper, conical surface thereof, and may be either protrusions or recesses, to permit engagement for rotary movement. The upstanding shoulder 153*a* of the lower plate or element 151*a* is provided with a notch 178 therein, of sufficient size to receive the lug 176. The lug 176 may be downwardly extended, and inclined surfaces may be provided either on lug 176 or on the underside of the shoulder 153*a***, or both, so that upon rotation of the upper plate or element 165*a*, the lug 176 will engage beneath the shoulder 153*a*, thereby being locked in position, and providing interengagement and a locking relationship at the peripheral edge of the upper element 165*a* with the lower element 151*a*. For purposes of clarity, the membrane 12 has been omitted from FIG. 10, but will, of course, occupy substantially the same configuration as shown in FIG. 8.

Figure 11:
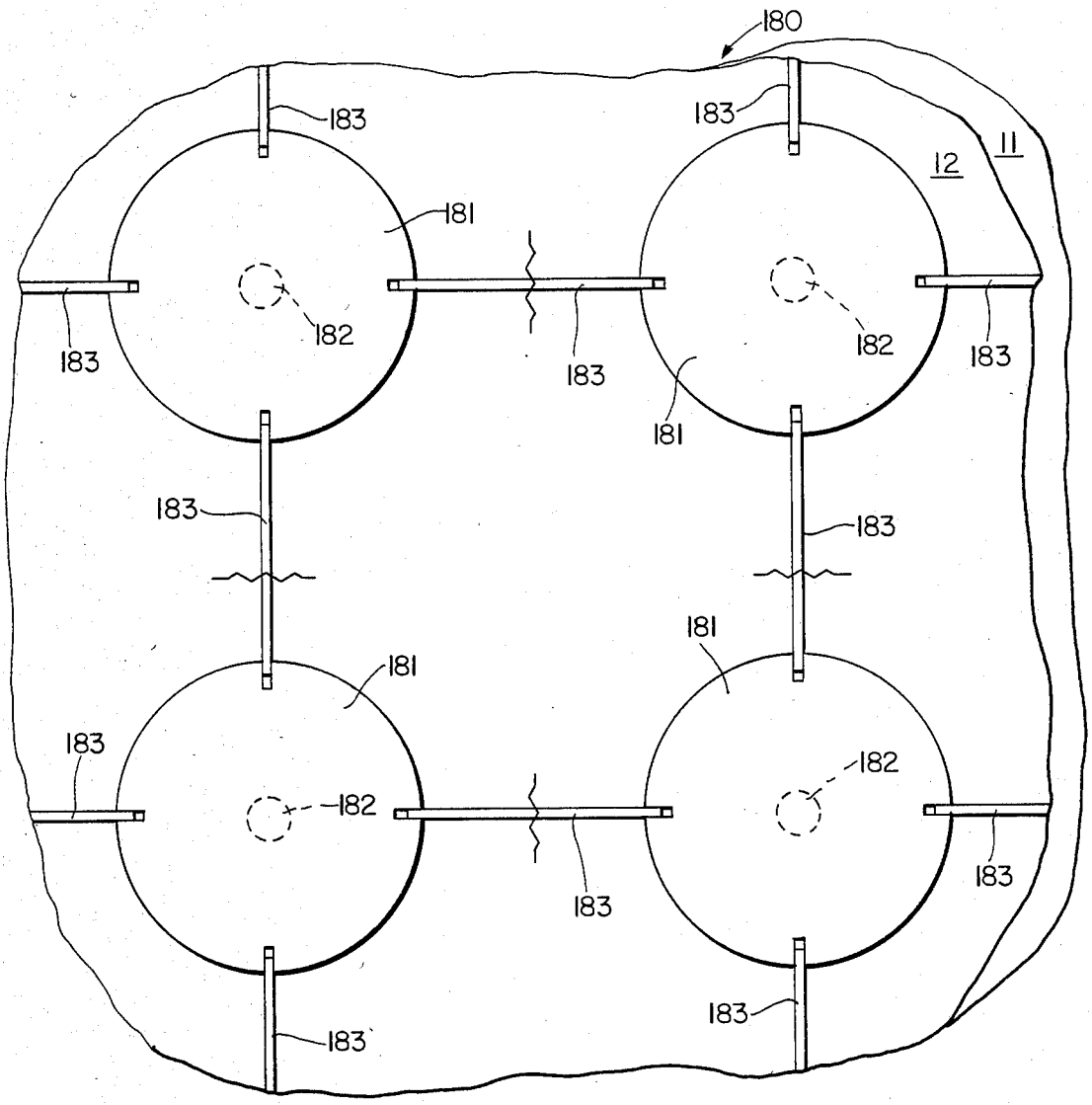
FIG. 11 is a plan view of a portion of a roof provided with a membrane anchoring structure in accordance with the present invention.
Figure 12:
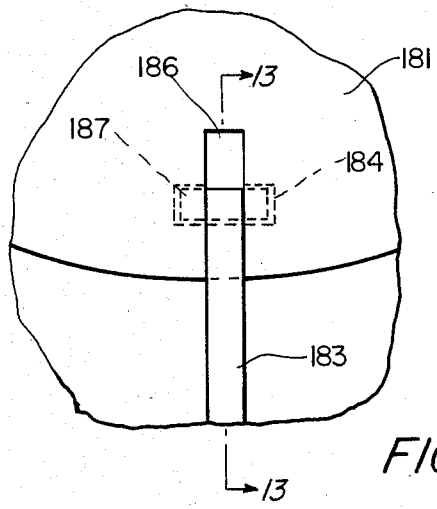
FIG. 12 is a detailed view of a portion of a disc or plate forming a part of the structure of FIG. 11.
Figure 13:
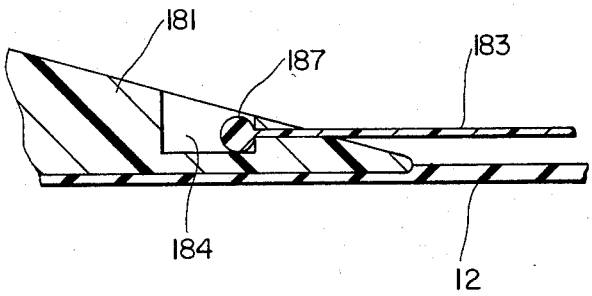
FIG. 13 is a cross-sectional view taken on the line 13—13 of FIG. 12.

In FIGS. 11–13, there is shown a roof membrane anchoring system generally designated 180, and including, placed on the substrate 11 a membrane 12 as hereinabove described. Placed over the membrane, at spaced locations, are a plurality of membrane anchoring elements 181. These membrane anchoring elements may be the upper plate or element of a dual plate or dual element roof membrane anchoring system as hereinabove set forth and described, or, alternatively, may be an element of a single (upper only) plate or element roof membrane anchoring system. That is, the anchoring element 181 may be of either a single plate or a dual plate type. As is conventional, the elements 181 are placed on the roof in a generally grid-like pattern, with spacing determined in accordance with anticipated wind conditions. Each of the anchoring elements 181 wil be secured to the substrate 11 by one or more fasteners, generally indicated at 182. Here, the fasteners are shown in dashed lines, to indicate that they are either beneath a body of mastic, as shown in FIG. 1, or beneath an upper element as shown in FIGS. 5, 6 and 8.

Connected to and extending between adjacent anchoring elements 181 are linearly extending strips 183.

As shown in FIGS. 12 and 13, tne anchoring element 181 may be provided with a transverse recess 184, with a radially extending entry slot 186. The linear strip 183 is provided with a transverse or T-shaped head 187, and it will be understood that the linearly extending strip 183 is of some flexible material, such as a weather-resistent plastic. In this way, the transverse head 187 at each end of the linearly extending stip 183 may be turned to pass through the entry slot 186, and then turned to occupy the position shown in FIGS. 12 and 13. As thus assembled, there is a grid-like array of anchoring elements 181, each, preferrably, connected to each adjacent anchoring element 181 by the linear strip 183.

Should there be a wind of sufficient strength to tend to raise the membrane 12, the membrane 12 will be restricted in its upward movement by the linearly extending strips 183, which are held, of course, by the various anchoring elements 181. The amount of lifting of the membrane 12 will be greatly restricted, thereby reducing the uplift forces on the membrane tending to separate the anchoring element 181 from the membrane 12 and/or the substrate 11. Any lifting will be limited to the spacing between the strips 183, preventing large billows, and reducing uplift forces caused by aerodynamic effects.

As will be understood, the specific connection of the linear strips to the various anchoring elements 181 is illustrative, only. Hence, other connections than the configuration shown particularly in FIGS. 12 and 13 may be utilized, and, indeed, the linearly extending strips 183 may be secured by such connections as snap hooks, hook and eyes, etc. Further, the linearly extending strips 183 may be secured to a fastener, directly or through an intermediary element other than the anchoring element 181.

There has been provided a roof membrane anchoring system utilizing dual plates, a first place being secured to the roof substrate and a second plate being above the first plate, and sandwiching and compressing a water and moisture impervious membrane between the two plates. The plates are secured to the roof substrate by one or more linear fasteners, providing greater security in locations of high wind forces. A first group of one or more fasteners may extend through and secure the lower plate to the roof substrate, and a separate fastener may then secure the upper plate to the lower plate or element, or the fastener of the second group may extend through both plates or elements and the membrane, and secure the entire assemblage to the substrate or to an underlying structural support, in this case an additional group of fasteners for fastening the lower plate or element to the roof substrate or structural support may be used or not.

In addition, there has been provided herein a membrane anchoring system in which penetration of the conventional non-thermoplastic membrane does not occur, due to a cooperative head and socket arrangement between a lower element secured to the roof substrate by suitable fasteners, and an upper plate or element having an engaging relationship with the lower plate or element, being secured to the lower plate or element, and clamping the membrane between the two plates or elements.

There has, in addition, been provided a construction for minimizing the lift forces on an anchoring element or elements, provided by linear strips extending between and connected to adjacent anchoring elements.

It will be obvious to those skilled in the art that various changes may be made without departing from the spirit of the invention, and therefore the invention is not limited to that shown in the drawings and described in the specification, but only as indicated in the appended claims.

I claim:

1. Roof membrane anchoring system structure for anchoring a water and moisture impervious membrane to a roof substrate comprising:

(a) upper and lower plates in superposed relationship, said lower plate on and engaging said substrate, (b) a membrane between said plates, (c) fastener means for holding the said lower plate to the roof substrate comprising at least one linear fastener extending into said substrate and directly securing only said lower plate thereto, and (d) means for compressively securing said upper plate against said membrane.

2. The roof membrane achoring system of claim 1, said substrate comprising rigid roof insulation, built-up roof, gypsum, wood, concrete or metal.

3. The roof membrane anchoring system of claim 1, said upper plate being of metal.

4. The roof membrane anchoring system of claim 3, said upper plate being resilient.

5. The roof membrane anchoring system of claim 1, said upper plate being plastic.

6. The roof membrane anchoring system of claim 1, said upper plate comprising means providing a mastic cavity between it and said membrane surrounding the central region of said upper plate.

7. The roof membrane anchoring system of claim 6, said mastic cavity being adjacent the center of said upper plate.

8. The roof membrane anchoring system of claim 7, said upper plate further comprising means providing a second surrounding mastic cavity spaced from the first mentioned mastic cavity.

9. The roof membrane anchoring system of claim 8, said upper plate further comprising a surrounding depression therein separating said first and second mastic cavities, and bearing against said membrane.

10. The roof membrane anchoring system of claim 6, said mastic cavity being annular.

11. The roof membrane anchoring system of claim 1, said upper plate comprising a central contact region for engaging said membrane, a surrounding cavity for mastic outwardly thereof, a surrounding contact region outwardly of said mastic cavity, a second surrounding mastic cavity outwardly of said contact region, and a peripheral compression region engaging said membrane outwardly of said outer mastic cavity.

12. The roof membrane anchoring system of claim 1, wherein at least one of said upper plate and said lower plate is of disc shape in plan form.

13. The roof membrane anchoring system of claim 1, wherein both the upper plate and lower plate are of disc shape in plan form.

14. The roof membrane anchoring system of claim 1, said upper plate securing means comprising a linear fastener extending therethrough.

15. The roof membrane anchoring system of claim 14, and further comprising means for connecting said linear fastener to said lower plate.

16. The roof membrane anchoring system of claim 15, said last mentioned means comprising thread means on said linear fastener and on said lower plate.

17. The roof membrane anchoring system of claim 14, said upper plate and said lower plate having aligned holes, and said linear fastener passing through said aligned holes and into said substrate.

18. The roof membrane anchoring system of claim 1, said lower plate having a down-turned peripheral edge.

19. The roof membrane anchoring system of claim 1, said lower plate having an upstanding surrounding ridge outwardly of the center thereof, said upper plate having a peripheral edge region overlying at least a part of said upstanding ridge of said lower plate.

20. The roof membrane anchoring system of claim 1, said upper plate and said lower plate having means defining complimentary annular ridges and grooves, portions of said membrane being in said complimentary ridges and groove.

21. The roof membrane anchoring system of claim 1, aligned holes in said upper and lower plates and said fastener means comprising a fastener extending through said holes into said substrate, said fastener having a head engaging said upper plate for securing said upper plate against said membrane.

22. The roof membrane anchoring system of claim 21, wherein said fastener means for holding said lower plate to a roof substrate comprises fastener means spaced from the center of said lower plate and extending into said substrate.

23. The roof membrane anchoring system of claim 1, and means for securing said upper plate comprising interengaging head and socket means on said upper and lower plates.

24. Roof membrane anchoring structure for anchoring a water and moisture impervious membrane to a roof substrate comprising:

(a) a lower member for placement in engagement with a roof substrate and comprising means outwardly of the central part thereof defining re-entrant groove means, (b) a membrane extending over said lower member, (c) an upper member on said lower member having at least a portion thereof engaging in at least a portion of said re-entrant groove means, with said membrane in at least a portion of said re-entrant groove means between said portion of said upper member and said means defining said re-entrant groove means of said lower member, and (d) means for securing said lower member to said substrate.

25. The roof membrane anchoring system of claim 24, said securing means comprising a linear fastener extending through said lower member and into said substrate.

26. The roof membrane anchoring system of claim 24, wherein said linear fastener extends only through said lower member and into said substrate.

27. The roof membrane anchoring system of claim 24, wherein one said member comprises an enlarged head on a supporting neck, and said head comprises means for permitting said head to be radially contractible and resiliently urged to its non-contracted state, and said other member comprises socket means for receiving said head.

28. The roof membrane anchoring system of claim 27, said upper and lower members having camming surfaces for causing contraction of said head by said other member.

29. The roof membrane anchoring system of claim 28, said head and socket means comprising opposed shoulders for resisting removal of said upper member from said lower member.

30. The roof membrane anchoring system of claim 29, said camming surfaces comprising a rounded edge of said head.

31. The roof membrane anchoring system of claim 28, said camming surfaces comprising a truncated cone on said head.

32. The roof membrane anchoring system of claim 27, said head being axially divided to permit contraction thereof.

33. A roof membrane anchoring system for anchoring a water and moisture impervious membrane to a roof substrate comprising:

(a) a plurality of spaced disc means over said membrane, (b) means securing each of said disc means to said substrate, (c) and linear means extending from and secured to said disc means and overlying said membrane.

34. The roof membrane anchoring system of claim 33, said linear extending means being secured to peripheral edges of said disc means, each being secured to two adjacent disc means.

35. The roof membrane anchoring system of claim 34, said linear means extending in a grid-like pattern.

36. Roof membrane anchoring structure for anchoring a water and moisture impervious membrane to a roof substrate comprising:

(a) a lower member for placement in engagement with a roof substrate, (b) a membrane extending over said lower member, (c) an upper member on said lower member, (d) means for securing said lower member and to said substrate, (e) complimentary male and female head and socket means on said upper and lower members for securing said upper member to said lower member with said membrane therebetween, (f) said head being axially divided to permit radial contraction thereof and resiliently urged to its non-contracted state.

* * * * *